US009640185B2

(12) United States Patent
Kushner et al.

(10) Patent No.: US 9,640,185 B2
(45) Date of Patent: May 2, 2017

(54) METHOD AND APPARATUS FOR ENHANCING THE MODULATION INDEX OF SPEECH SOUNDS PASSED THROUGH A DIGITAL VOCODER

(71) Applicant: MOTOROLA SOLUTIONS, INC, Shaumburg, IL (US)

(72) Inventors: William M Kushner, Arlington Height, IL (US); Robert J Novorita, Orland Park, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 292 days.

(21) Appl. No.: 14/104,777

(22) Filed: Dec. 12, 2013

(65) Prior Publication Data

US 2015/0170659 A1 Jun. 18, 2015

(51) Int. Cl.

| | |
|---|---|
| ***G10L 21/02*** | (2013.01) |
| ***G10L 21/00*** | (2013.01) |
| ***G10L 19/00*** | (2013.01) |
| ***G10L 19/02*** | (2013.01) |
| ***G10L 21/0232*** | (2013.01) |
| ***G10L 21/0224*** | (2013.01) |
| ***G10L 19/26*** | (2013.01) |

(52) U.S. Cl.

CPC ..... *G10L 19/0019* (2013.01); *G10L 19/02* (2013.01); *G10L 19/26* (2013.01); *G10L 21/02* (2013.01); *G10L 21/0224* (2013.01); *G10L 21/0232* (2013.01)

(58) Field of Classification Search

USPC ..... 704/200–230, 270, 500–504, 704/E19.001–E19.049, E21.001–E21.02

See application file for complete search history.

(56) References Cited

U.S. PATENT DOCUMENTS 3,403,227 A * 9/1968 Malm ..... G10L 19/00 324/76.12
3,959,592 A * 5/1976 Ehrat ..... H04K 1/00 380/275

(Continued)

FOREIGN PATENT DOCUMENTS

| | | |
|---|---|---|
| EP | 0764940 A2 | 3/1997 |
| WO | 9933237 A1 | 7/1999 |

OTHER PUBLICATIONS

Chilin Shih, "Synthesis of Trill", 1996, ICSLP 96, Proceedings, Fourth International Conference on Spoken Language, vol. 4, pp. 2223-2226.

(Continued)

*Primary Examiner* — Pierre-Louis Desir
*Assistant Examiner* — David Kovacek
(74) *Attorney, Agent, or Firm* — Barbara R. Doutre

(57) ABSTRACT

A method and apparatus for enhancing modulation of certain speech sounds, such as trill sounds, are provided for radios which utilize digital vocoders. A digitized speech stream is sampled and the sampling is adjusted to determine, detect and enhance trill nulls in the digitized voice stream by one or more of: frame shifting the digitized speech input stream prior to vocoding, time expanding a digitized speech steam prior to vocoding, time compressing a digitized speech output stream after vocoding, and/or modulation enhancement and filtering of the a digitized speech output stream after vocoding.

7 Claims, 10 Drawing Sheets

(56) References Cited

U.S. PATENT DOCUMENTS 4,064,363 A * 12/1977 Malm ..... G10L 19/02 704/203
4,885,790 A * 12/1989 McAulay ..... G10L 19/02 704/261
5,327,520 A * 7/1994 Chen ..... G10L 19/12 704/200
5,333,275 A * 7/1994 Wheatley ..... G10L 15/18 704/231
5,414,796 A * 5/1995 Jacobs ..... G10L 19/005 704/201
5,668,926 A * 9/1997 Karaali ..... G10L 13/08 704/232
5,701,390 A 12/1997 Griffin et al.
5,715,367 A * 2/1998 Gillick ..... G10L 15/063 704/244
5,729,694 A * 3/1998 Holzrichter ..... G10L 15/24 704/270
5,754,974 A 5/1998 Griffin et al.
5,799,276 A * 8/1998 Komissarchik ..... G10L 15/04 704/207
5,953,696 A 9/1999 Nishiguchi et al.
6,006,175 A * 12/1999 Holzrichter ..... A61B 5/0507 704/205
6,067,511 A 5/2000 Grabb et al.
6,356,545 B1 * 3/2002 Vargo ..... H03M 13/03 370/355
6,549,884 B1 * 4/2003 Laroche ..... G10L 21/003 704/203
6,691,082 B1 * 2/2004 Aguilar ..... G10L 19/0208 704/219
6,732,073 B1 * 5/2004 Kluender ..... G10L 15/02 704/200.1
6,912,496 B1 6/2005 Bhattacharya et al.
7,065,485 B1 6/2006 Chong-White et al.
2002/0005108 A1 * 1/2002 Ludwig ..... G10H 1/00 84/600
2003/0152152 A1 * 8/2003 Dunne ..... G10L 19/18 375/241
2004/0267540 A1 * 12/2004 Boillot ..... G10L 21/04 704/278
2005/0065784 A1 * 3/2005 McAulay ..... G10L 19/093 704/205
2006/0133358 A1 * 6/2006 Li ..... H04B 3/23 370/352
2006/0239377 A1 10/2006 McCoy et al.
2006/0270467 A1 11/2006 Song et al.
2007/0055501 A1 * 3/2007 Aytur ..... H04B 1/7183 704/219
2007/0213987 A1 * 9/2007 Turk ..... G10L 13/033 704/268
2009/0222268 A1 * 9/2009 Li ..... G10L 13/04 704/261
2011/0099018 A1 * 4/2011 Neuendorf ..... G10L 21/038 704/500
2012/0095767 A1 * 4/2012 Hirose ..... G10L 13/033 704/258
2015/0170659 A1 * 6/2015 Kushner ..... G10L 19/26 704/500

OTHER PUBLICATIONS

Dhananjaya, N et al.: "Acoustic analysis of trill sounds", The Journal of the Acoustical Society of America, American Institute of Physics for the Acoustical Society of America, New York, NY, US, vol. 131, No. 4, Apr. 1, 2012, pp. 3141-3152.

Shih C Ed—Bunnell H T et al.: "Systhensis of trill", Spoken Language, 1996, ICSLP 96. Proceedings, Fourth International Conference on Philiadelphia, PA, USA Oct. 3-6, 1996, New York, NY, USA, IEEE, US, vol. 4, Oct. 3, 1996, pp. 2223-2226.

The International Search Report and the Written Opinion, PCT/US2014/067056, filed Nov. 24, 2014, mailed Apr. 1, 2015, all pages.

* cited by examiner

1000

METHOD AND APPARATUS FOR ENHANCING THE MODULATION INDEX OF SPEECH SOUNDS PASSED THROUGH A DIGITAL VOCODER

FIELD OF THE DISCLOSURE

The present disclosure relates generally to radio communications and more particularly to the processing of speech signals in radio communication devices.

BACKGROUND

Land mobile radios providing two-way radio communication are utilized in many fields, such as law enforcement, public safety, rescue, security, trucking fleets, and taxi cab fleets to name a few. Land mobile radios include both vehicle-based and hand-held based units. Digital land mobile radios have additional processing inside the radio to convert the original analog voice into digital format before transmitting the signal in digital form over-the-air. The receiving radio receives the digital signal and converts it back into an analog signal so the user can hear the voice. Examples of digital radio are radios that comply with the APCO-25 standard or TETRA standard. However, digital radios have sometimes been perceived to distort certain speech sounds. In particular, speech sounds having alveolar trills, such as the rolled 'r' used in Spanish and Italian languages, can be perceived as sounding distorted, flat or slurred.

In radio operation, incoming audio speech into a microphone is converted by an analog-to digital (A/D) converter) resulting in digitized speech signal which is input to a vocoder. Narrowband vocoders are used in digital radio products. FIG. 1 is a graphical example 100 comparing pre-vocoder trill sounds to post-vocoder trill sounds in accordance with the prior art. Graphs 102 and 104 show time versus amplitude for two speech samples. Uncoded alveolar trills 106 and 110 (pre-vocoder) are shown in graph 102. Corresponding post-vocoder coded/decoded alveolar trills 108 and 112 are shown in graph 104. As shown in graph 104, the alveolar trills 108 and 112 are smeared and are thus not encoded correctly by the narrowband vocoder causing intelligibility problems, especially in Italian and Spanish. Because vocoders are typically regulated by the standard within which they operate, they cannot be easily modified.

Accordingly, a means to improve the fidelity of vocoded higher modulation rate speech sounds without modifying the vocoder is needed.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
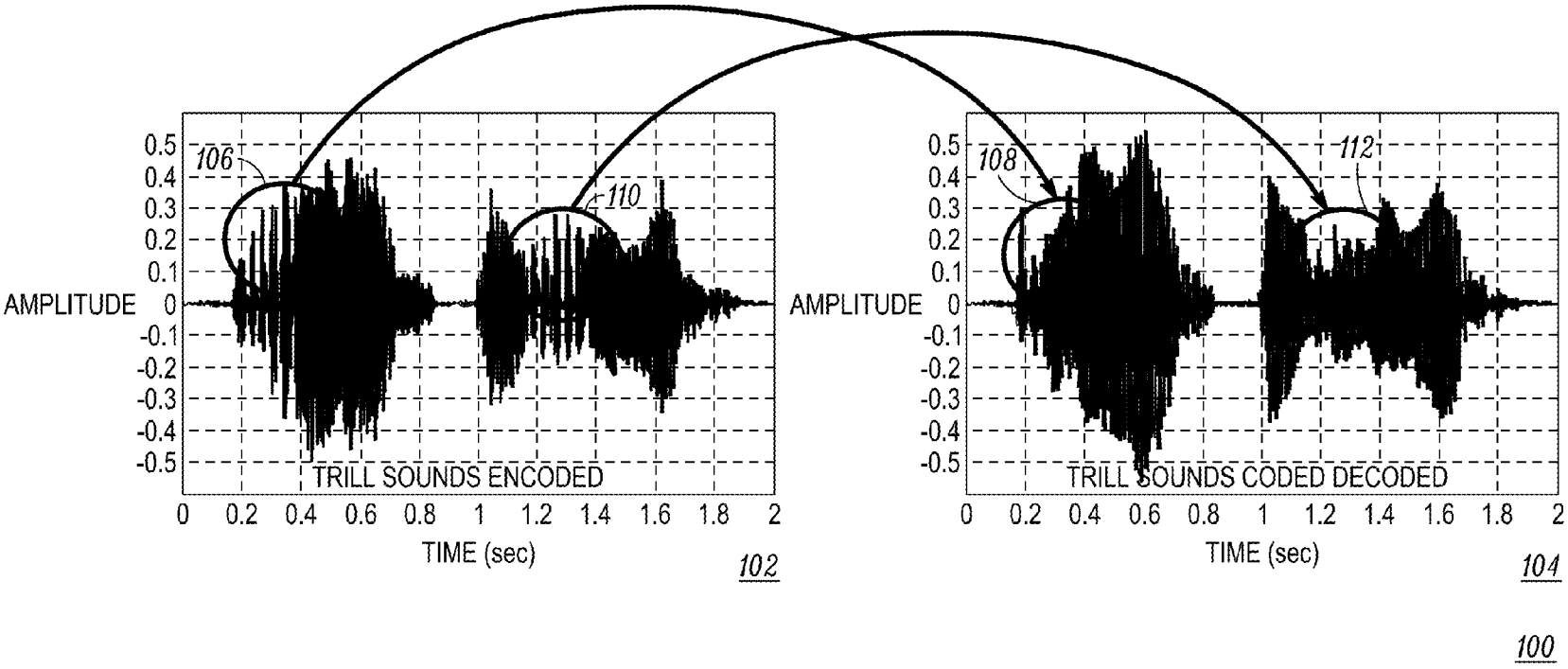
(PRIOR ART) FIG. 1
FIG. 1 is a graphical example comparing pre-vocoder trill sounds to post-vocoder trill sounds in accordance with the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there are described herein methods and apparatus for enhancing the modulation index of speech sounds passed through a digital vocoder. Methods for improving high modulation rate sound encoding, particularly for trill sound intelligibility, are provided. The methods and apparatus address speech envelope modulation coding errors caused by the slow frame energy analysis rate inherent in low bit rate parametric vocoders, such as the Improved Multi-Band Excitation (IMBE™) and Advanced Multi-Band Excitation (AMBE©) class of vocoders produced by DVSI Inc. Speech envelope modulation coding errors and aliasing artifacts caused by the sub-Nyquist frame rate used in narrowband vocoders are resolved.

Narrowband vocoders are used in digital radio products. Depending on type of vocoding techniques, the vocoder also "compresses" the resulting sample so that it can fit into a narrower bandwidth. The information content of human speech is encoded by the vocoder using acoustic frequency and amplitude modulation. The phonemic information stream is broken into syllables encoded as energy envelope modulation. The syllabic modulation rate of speech is typically less than 16 Hz with the vast majority of amplitude modulation energy occurring in the 0.5-5 Hz range. However, as mentioned previously in some languages, such as Italian and Spanish, certain sounds, most notably the alveolar trill (e.g. trilled "r"), carry important phonemic information encoded in amplitude modulation at a higher rate of from 20-40 Hz. In low bit rate parametric vocoders, the signal energy parameter which encodes the waveform amplitude modulation is calculated at a low frame rate, typically 50 frames/sec or less. In addition, frame overlapping and other forms of parameter smoothing are employed to reduce coding artifacts. For languages such as English with low syllabic modulation rates this is not a problem. However, for sounds that are defined by a higher amplitude modulation rate such as the alveolar trill, vocoding can cause the energy modulation component to be poorly defined due to frame smoothing and aliasing, reducing the perceptibility and intelligibility of the sound. While a straightforward solution would be to increase the frame analysis rate, this cannot be done without increasing the vocoder bit rate or modifying the vocoder parameter rate in some other way. Because vocoders are typically regulated by the standard within which they operate, they cannot be easily modified.

In accordance with the various embodiments, pre-processing and post processing approaches are provided to enhance certain types of speech sounds. A plurality of pre-vocoder processor modules and post-vocoder processor modules are provided to enhance the modulation index of trilled speech sounds, particularly the alveolar trill, to make them more perceptible after passing through a narrowband vocoder. Narrowband vocoders typically employ a frame analysis rate that is too low for accurately reproducing higher frequency speech amplitude modulations. Since the frame rate of the vocoder cannot be increased, the pre and post processors provided herein are utilized to enhance the modulation though time shifting, time expansion, and modulation domain filtering. Several techniques are proposed. Some of these techniques depend on detecting the presence of a high modulation rate speech sound and determining the time location and frequency of the modulation nulls. This information is used by subsequent methods.

Figure 2:
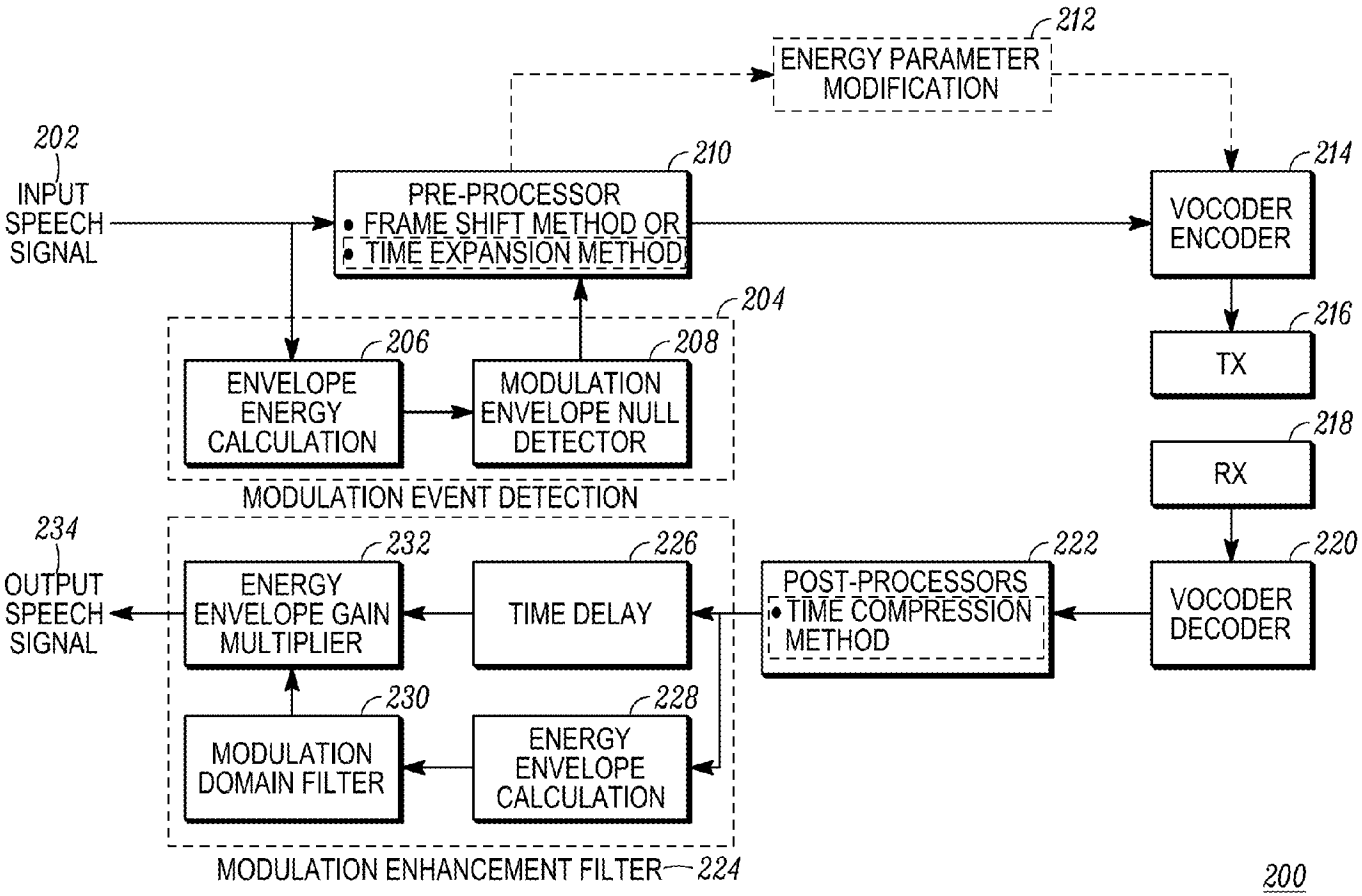
FIG. 2 illustrates a block diagram of a plurality of speech enhancement approaches in accordance with various embodiments.

FIG. 2 illustrates a block diagram of various speech enhancement approaches in accordance with some embodiments. The block diagram 200 improves sound intelligibility for signals processed through a digital vocoder. The digital vocoder is shown in FIG. 2 as vocoder encoder 214 and vocoder decoder 220 to differentiate between signals being transmitted out and signals being received at the vocoder. The block diagram 200 shows a digitized input speech signal 202 being processed by one or more pre-vocoder processing stages prior to being encoded by vocoder encoder 214 for transmission at 216. For an incoming signal received at 218, the vocoder decoder 220 decodes and processes the signal through one or more post-vocoder stages to generate output speech signal 234. The various embodiments will show that speech enhancement can be achieved with either pre-vocoder processing alone, post-vocoder processing alone, and/or a combination of both pre-vocoder and post-vocoder processing.

The block diagram 200 will be used to describe four different methods for enhancing speech through the digital vocoder. The Table below summarizes these approaches:

| | Pre-vocoder | Post-vocoder |
|---|---|---|
| Frame Shifting (210) | x | |
| Energy Parameter Modification (212) | x | |
| Time Expansion (210)/Time Compression (222) | x | x |
| Modulation Enhancement Filter (224) | | x |

Figure 6:
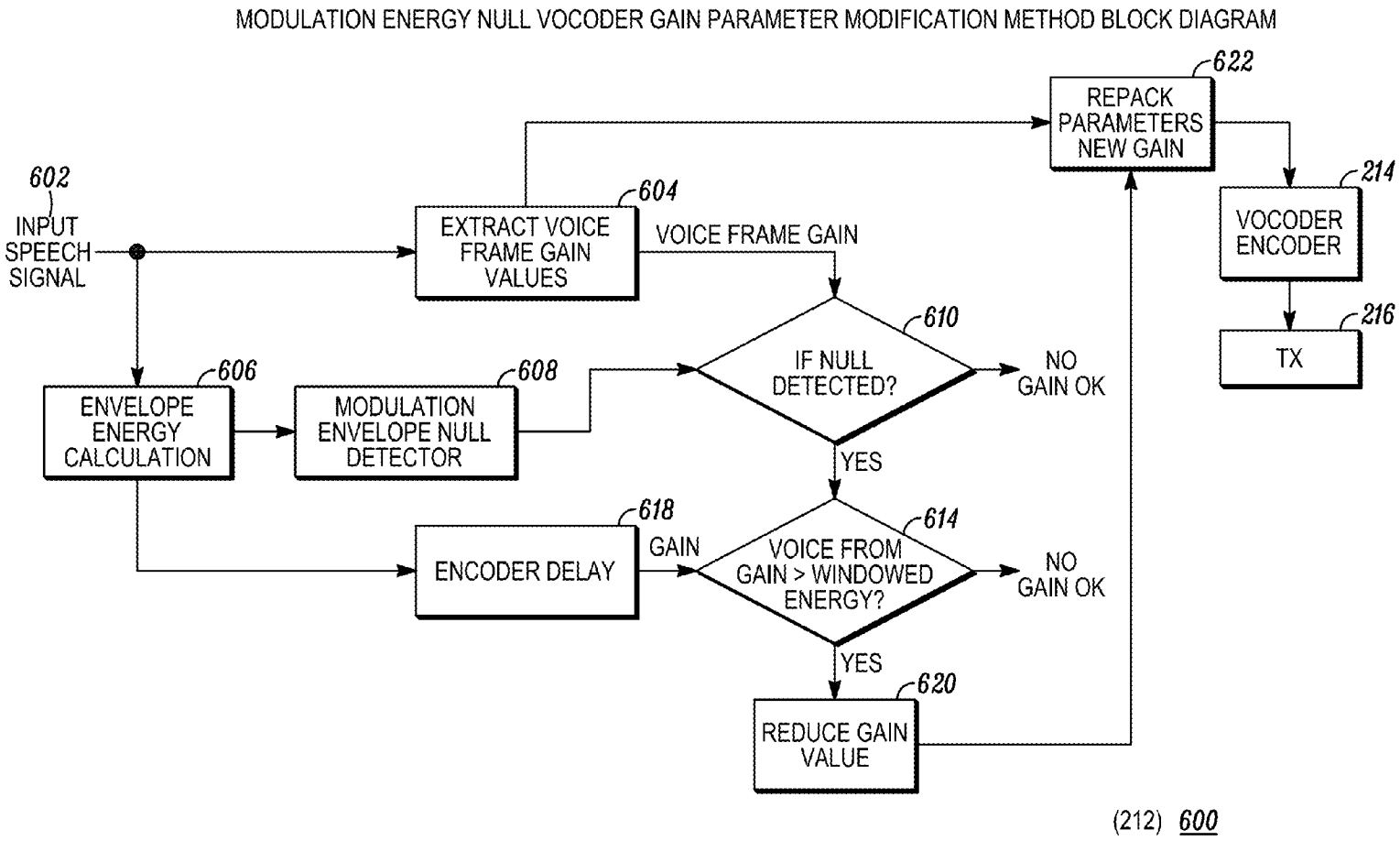
FIG. 6 shows a more detailed block diagram of the modulation energy null vocoder gain parameter modification method in accordance with an embodiment.

Both the frame shift method 210 and the energy parameter modification method 212 make use of a modulation event detection 204 which comprises envelope energy calculation 206 and modulation envelope null detector 208. These will be further described in expanded diagrams of FIG. 3 for frame shifting and FIG. 6 for energy parameter modification.

In a first method, a predetermined analysis frame is shifted in time slightly so as to maximally capture the energy nulls of the trill modulation. This is essentially a re-sampling of the energy envelope with a phase shift. In operation, the input digitized speech signal 202 is received and run through a pre-vocoding processing step 210, the processing step 210 provides the frame shift method.

Figure 3:
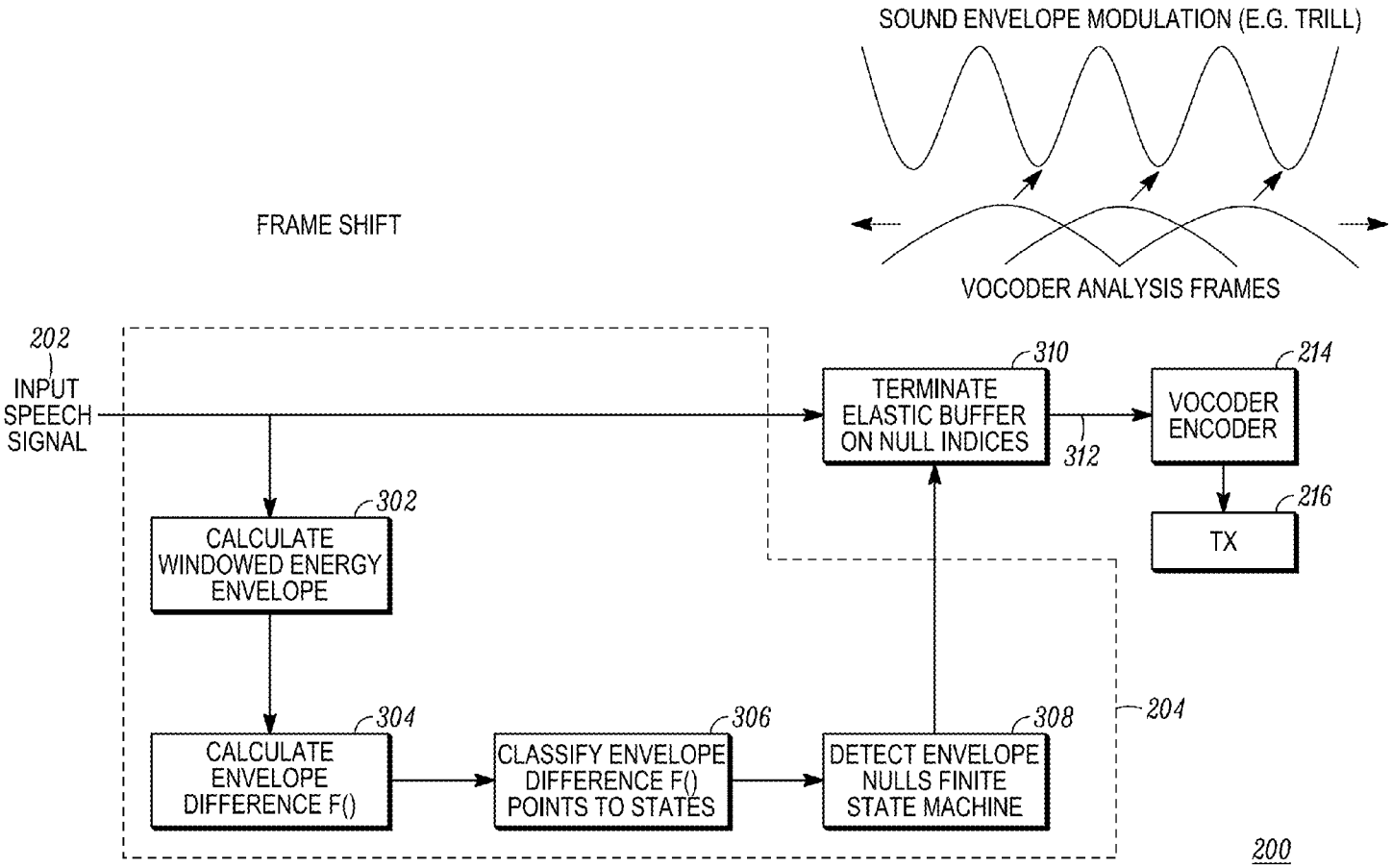
FIG. 3 provides detailed steps for a frame shift approach of FIG. 2 in accordance with an embodiment.
Figure 4:
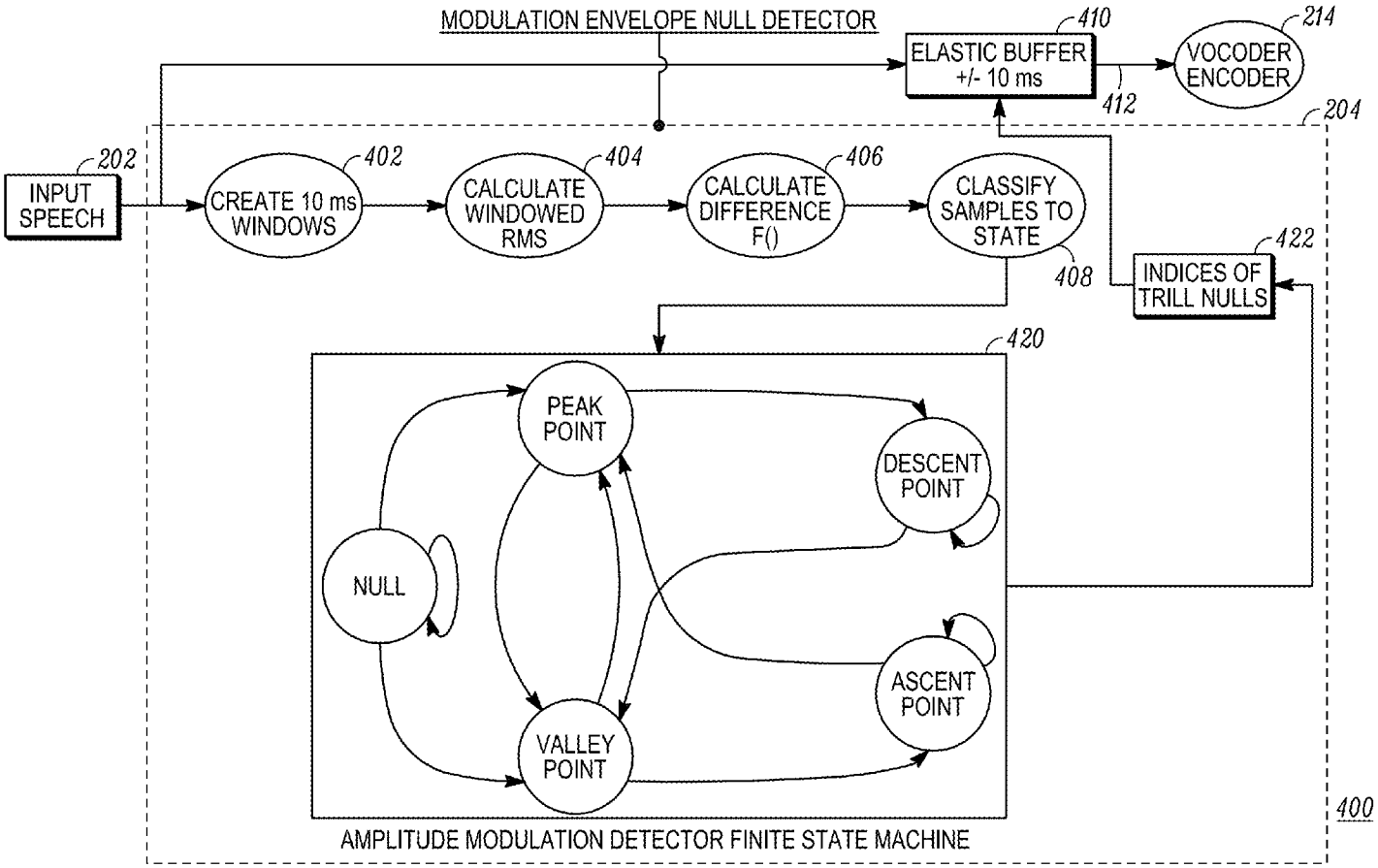
FIG. 4 shows a modulation envelope null alignment state machine which corresponds with FIG. 3 in accordance with an embodiment.

The frame shift approach is described in FIGS. 3 and 4 with further detailed steps. Referring to FIG. 3, an input digitized speech signal is received at 202 over a first predetermined sampling rate of windows. Processing block 204 provides envelope energy calculations and null detection. Envelope differences (modulation frequency and energy differences between the original input signal and those calculated at the frame rate of the vocoder) are calculated at 304. This calculation can be done by a differential energy calculator to determine inter-frame differences. At 306, the envelope differences f( ) are sampled and classified for points and states (peaks and valleys) by an energy difference classifier to define a state machine. The state machine operates at 308 to determine the location of modulation nulls of the speech envelope. The state machine identifies energy envelope nulls and locates them in time and frequency. An elastic data buffer at 310 allows a frame of data to be shifted forward or backward in time relative to the vocoder frame sampling time (aligns with frame shift 210 of FIG. 2). The analysis frame is thus able to be shifted forward or backward in time to coincide with detected modulation amplitude nulls.

FIG. 4 shows a diagram 400 of modulation envelope null detector having modulation envelope null alignment state machine which corresponds with FIG. 3. Again, the digitized signal is received at 202 and runs through processing block 204 and an elastic buffer 410 (frame shift 210 of FIG. 2) which can shift backward and forward to align with detected nulls. The forward and backward shift is controlled by the creation of windowed energy envelopes at 402, calculated energy within the windowed envelope at 404, calculation of envelope differences points at 406, and the classification of samples to states at 408. The classification of states can include peak points, descent points, ascent points, and null points as seen at amplitude modulation detector finite state machine 420. The indices of nulls are then passed through the elastic buffer 410, the elastic buffer terminates on the null indices prior to encoding of the enhanced trill signal to vocoder encoder 214.

Figure 5:
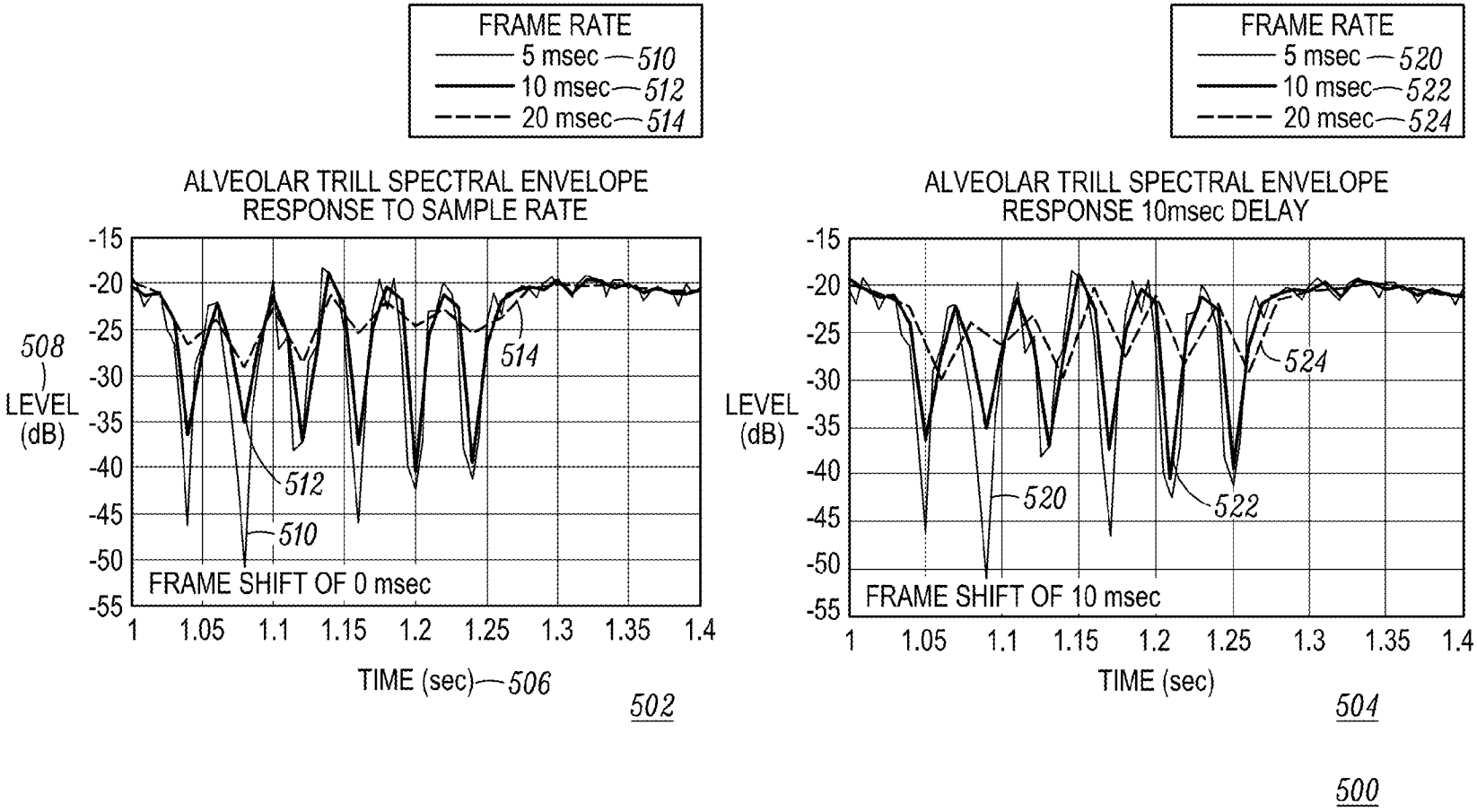
FIG. 5 shows graphical examples of sampled trill signals at the output of the vocoder with and without frame shifting in accordance with the frame shifting embodiment.

The frame shifted signal 412 is then encoded through the encoder at 214 and transmitted at 216. FIG. 5 shows graphical examples 500 of sampled trill signals at the output of the vocoder with and without frame shifting in accordance with the frame shifting embodiment. Alveolar trill spectral envelope responses to different frame sample rates are shown in graph 502 (with zero frame shift). Time is indicated along the horizontal axis 506 and decibel levels (dB) on the vertical axis 508. Frame rate windows (such as the windows created at 402 in FIG. 4) are created at 5 msec (510), 10 msec (512), and 20 msec (514). In graph 504, alveolar trill spectral envelope responses to different frame sample rates are shown with a 10 msec time shift. This frame shift is generated at the elastic buffer 310 of FIG. 3 and 410 of FIG. 4. Again, the frame rate windows were created at 5 msec (520), 10 msec (522), and 20 msec (524). However, the 10 msec frame shift makes a significant improvement to the 20 msec delay signal, by approximately 3 to 5 dB. Thus, the trill coming out of the vocoder is advantageously far more pronounced with the frame shifting than without.

In accordance with the various embodiments, the frame shifting approach can be used on its own or in conjunction with the modulation enhancement filter method to be described later.

A second optional approach to providing speech enhancement provides a variation of the re-sampling by modifying the vocoder frame energy parameter directly to align better with the separately detected modulation nulls. This additional approach utilizes energy parameter modification 212 shown in FIG. 2 which is further detailed in FIG. 6 as modulation energy null vocoder gain parameter modification method 600 in accordance with an embodiment.

Digitized speech 602 is sampled as above, but at a faster frame rate (e.g. 100 frames/sec). Gain values are extracted from the voice frame at 604 while the energy envelope calculation is calculated at 606 (aligns with 206 of FIG. 2). Envelope nulls, within the envelope calculation, are detected at modulation envelope null detector 608 (aligns with 208 of FIG. 2), based on this higher sampled rate. If the state machine within 608 does not detect an envelope null, then the extracted voice frame gain associated with that sample (from 604) is considered satisfactory. If a null is detected at 610, the voice frame gain at 604 is passed through to 614 for a voice frame gain to envelope energy calculation comparison. The energy calculation at 606 is synchronized to the encoder by delay at 618.

At 614, the voice frame gain is compared to the delayed windowed energy. If the voice gain frame is determined to be too large at 614, then the gain is reduced at 620 and the parameters for the vocoder are repacked with the reduced new gain at 622. The signal then continues through the vocoder encoder 214 for transmission at 216.

Thus, alternative approach 600 provides pre-vocoder processing (212) that receives the modulation event null detector information, compares it with frame energy parameter information derived from the vocoder, and modifies the vocoder frame energy parameter to coincide with the detector null energy information.

Figure 7:
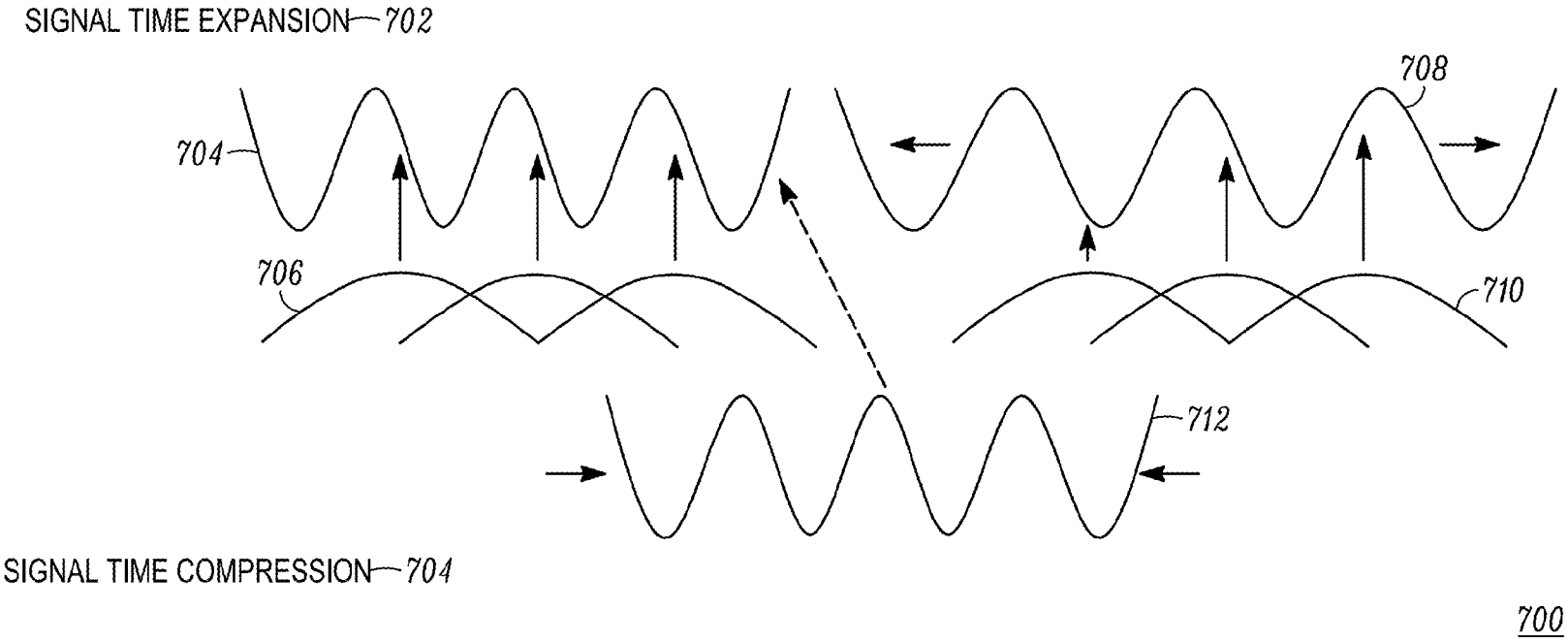
FIG. 7 is an illustrative example of a time compression and expansion approach in accordance with an embodiment.

In a third method for speech enhancement, the duration of the input speech is expanded in time to effectively decrease the trill modulation frequency so as to improve encoding at the fixed vocoder frame rate. FIG. 2 shows the time expansion within pre-vocoder processing block 210 in accordance with the third embodiment. At the vocoder decoder 220 output, the speech can then be expanded back to its original duration through time compression shown in post-processor block 222. The time expansion and compression approach 700 is illustrated in FIG. 7. The signal time expansion 702 is shown using original signal 704 and expanded signal 708. Time expanding the trill signal prior to vocoder encoding decreases the effective modulation frequency as seen in 708. Signal 704 shows a sound envelope modulation signal of a trill with the modulation frequency above a nyquist rate aliasing frequency along with vocoder analysis frame 706, at a fixed frame rate. A time expanded sound envelope of the trill shown at 708, shows a modulation frequency below that of the Nyquist rate without aliasing. The vocoder analysis frame remains the same at 710. A time compressed sound envelope modulation signal 712 has the original length and no aliasing. Thus, time compressing the signal after the vocoder decoding allows the signal to return to its original time duration. Also, the time compression step is not necessary if the time expansion is less than twenty (20) percent, since time expansion of a speech signal of less than (20) percent is not readily perceived by a listener.

Accordingly, if the time expansion is less than twenty percent (20%), then the time compression step is not necessary but can be applied if desired. If the time expansion is more than twenty percent (20%) then the time compression step should be applied.

There are a number of known methods for reversibly expanding and compressing a speech signal in time which can produce the desired change in modulation frequency needed for enhancing the trill sound modulation. One such method, for example, is the PSOLA method (Pitch Synchronous Overlap and Add). Other similar time modification methods may also be used.

Figure 8:
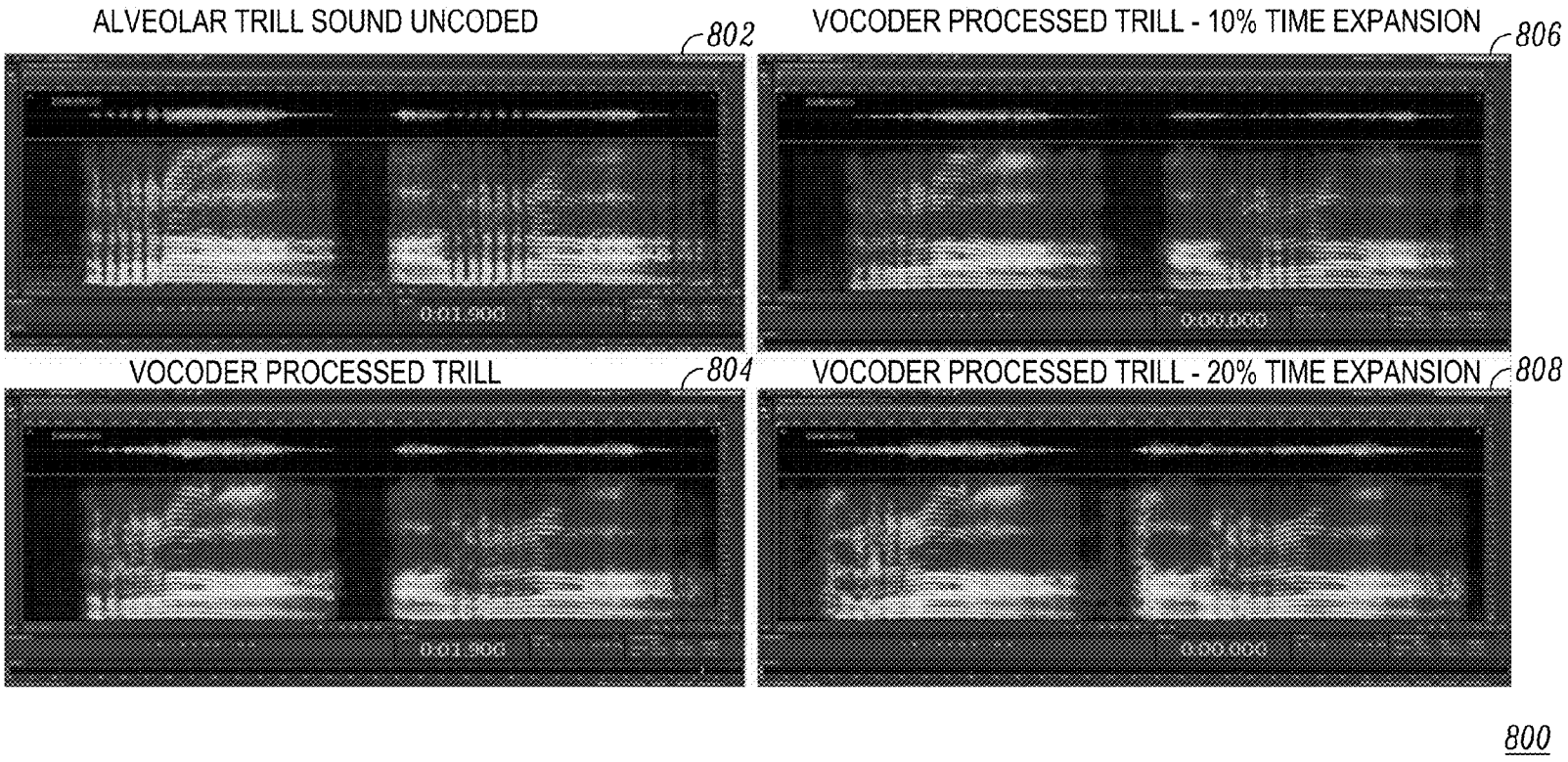
FIG. 8 shows examples of sample spectrograms comparing alveolar trills in accordance with the time expanded embodiments.

FIG. 8 shows examples of sample spectrogram images comparing alveolar trills in accordance with the time expanded embodiments. Image 802 shows the alveolar trill in an uncoded state. Image 804 shows the alveolar trill processed by the vocoder without any time expansion. Image 804 shows how smeared the trill becomes which leads to issues with intelligibility. Image 806 shows a ten (10) percent time expansion being applied prior to the vocoder with no time compression step. Image 808 shows a twenty (20) percent time expansion being applied prior to the vocoder. The application of time expansion prior to the vocoder thus greatly improved the intelligibility of the trill sound.

In a fourth method, the modulation index of the trill sound can be enhanced by extracting the speech energy modulation envelope, passing it through a frequency selective filter with positive gain applied at the trill modulation frequency. This fourth approach can also be used with an attenuating bandpass or lowpass filter to help remove higher frequency modulation components that cause aliasing. The enhanced modulation envelope is then impressed on the decoded speech signal stream. This fourth approach is illustrated in FIG. 2 by modulation enhancement filter 224 which comprises a time delay element 226, an energy envelope calculation element 228, a modulation domain enhancement filter 230, and energy envelope gain multiplier 232 coupled at the output of the vocoder 220.

In operation, the digitized signal comes out of the decoder 220 and the filter 224 enhances the trill sound by amplifying envelope modulation frequencies in the 20-40 Hz range. The filter 224 amplifies energy in the specified frequency range to provide emphasis to the trill modulation. The time delay component is necessary to delay the vocoder output signal in time to account for the signal delay caused by the modulation domain enhancement filter 230. This ensures that the modified modulation envelope will be time-aligned with the vocoder output signal. The energy envelope calculator 228 calculates the vocoder output energy envelope by squaring the signal samples. The vocoder output signal energy is a positive only signal that goes through the modulation domain filter 230, which can be a lowpass or bandpass filter. For example, a Chebyshev type 1, two pole low-pass filter can be used to produce a positive gain bump in the trill modulation band while passing lower modulation frequencies and suppressing higher modulation frequencies in accordance with the desired effects. The filter gain peak occurs at about the center of the trill sound modulation band (for this example 28 Hz, as will be shown in FIG. 9).

Figure 9:
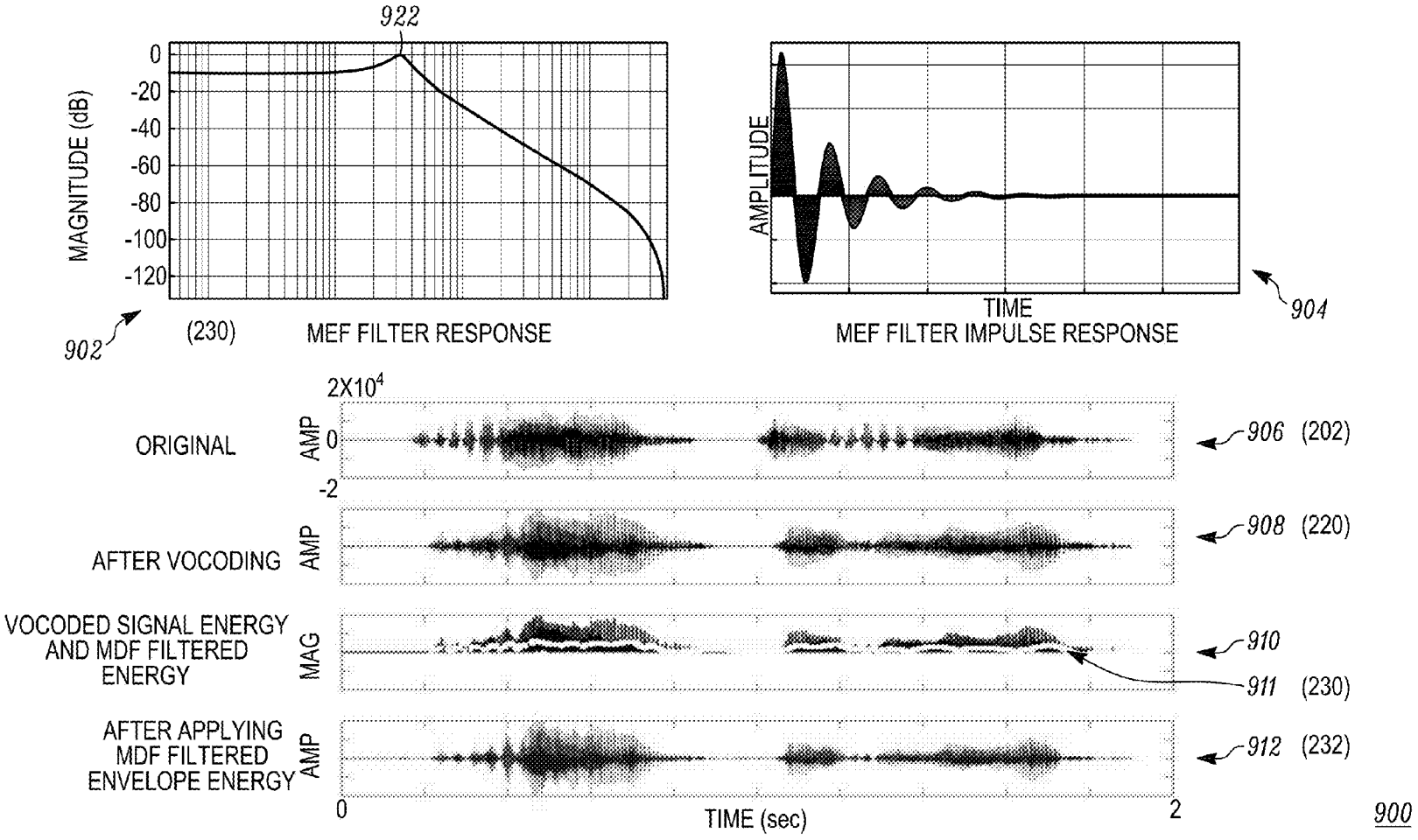
FIG. 9 shows examples of spectograms comparing alveolar trills in accordance with the modulation enhancement filter embodiments.

Examples for the Modulation Enhancement Filter (MEF) method are shown in FIG. 9. Modulation enhanced filter (MEF) response 902 shows magnitude (db) response for a two-pole Chebyshev type 1 filter with a gain peak 922 at the trill modulation frequency. This filter gain peak occurs at about the center of the trill sound modulation band (for this example 28 Hz). Graph 904 shows the impulse response time for the filter. This graph is representative of the modulation domain filter 230.

Waveforms 906, 908, 910, 911, and 912 are shown with time on a horizontal axis and amplitude (or magnitude for 910, 911) along a vertical axis. Waveform 906 shows the original input speech signal (202). Waveform 908 shows the signal after vocoding (220) without any enhancement. Waveform 910 shows the vocoded signal energy envelope. Waveform 911 shows the vocoded signal energy envelope after being filtered by modulation domain filter 230. The modulation domain enhancement filter provides a positive gain for the predetermined modulation frequencies of the calculated energy envelope.

Waveform 912 shows the signal after being filtered by modulation domain filter 230 and application of the energy envelope gain multiplier 232. Thus, the energy envelope gain multiplier 232 imposes the filtered modulation energy envelope on the delayed digitized speech stream 226. As can be seen by the waveform 912, the output speech signal having the modulation enhancement filter 224 applied thereto significantly enhances the modulation index and enhances the intelligibility of the trill sound.

Figure 10:
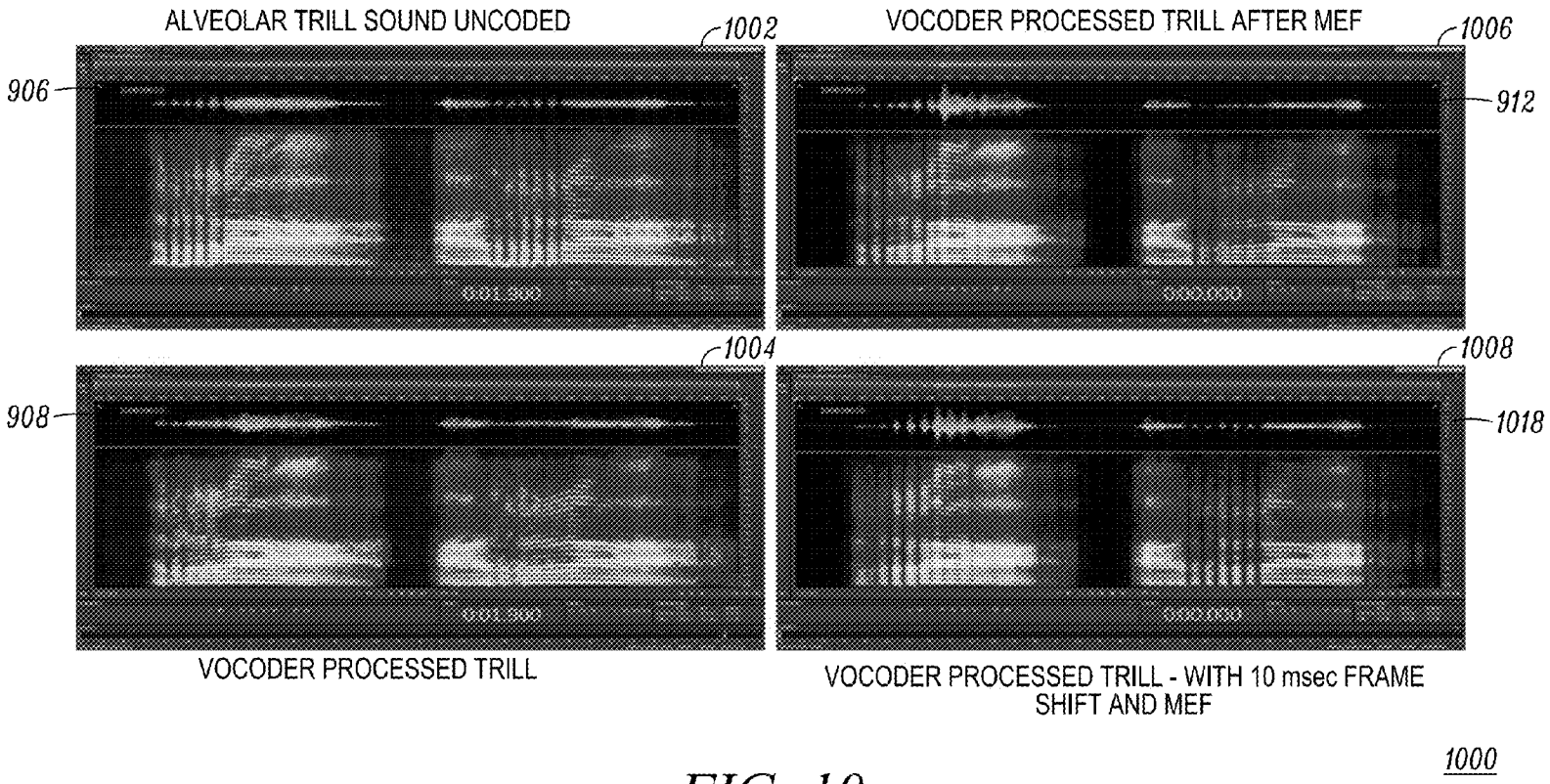
FIG. 10 shows images comparing alveolar trills in accordance with the modulation enhancement filter embodiments.

FIG. 10 shows spectrogram images comparing alveolar trills in accordance with the modulation enhancement filter embodiments. Spectogram 1002 shows the alveolar trill sound in an uncoded condition, corresponding to waveform 906 from FIG. 9. Spectogram 1004 shows the alveolar trill sound in after being vocoded, corresponding to waveform 908 from FIG. 9. Spectrogram 1006 shows the alveolar trill sound in after being vocoded and modulation enhancement filter 224 being applied, corresponding to waveform 910 of FIG. 9.

Spectogram 1008 shows the alveolar trill sound after being frame shifted using the frame shift method, vocoded, and the modulation enhancement filter 224 being applied. Note that the combination of the two different trill enhancement methods results in even better enhancement. The modulation enhancement filter method can be used with any of the other enhancement methods for increased effect.

Accordingly, four methods/approaches have been provided to improve speech enhancement in a digital radio product. In the first method, a predetermined analysis frame (e.g. 20 msec) is shifted in time slightly so as to maximally capture the energy nulls of the trill modulation. This frame shifting provides a re-sampling of the energy envelope with a phase shift. The second method provides a variation of the re-sampling to modify the vocoder frame energy parameter directly to align better with the separately detected modulation nulls. In the third method, the duration of the input speech is expanded to effectively decrease the trill modulation frequency so as to improve encoding at the fixed vocoder frame rate. At the decoder output the speech can be expanded back to its original duration. In a fourth method, the modulation index of the trill sound can be enhanced by extracting the speech energy modulation envelope, passing it through a frequency selective filter with positive gain applied at the trill modulation frequency. This fourth method can also be used with an attenuating lowpass or bandpass filter to remove aliased modulation components. The enhanced modulation envelope is then impressed on the decoded speech signal stream. These methods can be used singly or in combination for improved performance.

The pre- and post-processing elements provided by the various embodiments increase the modulation index of high modulation rate sounds without altering the vocoder. Increasing the modulation index of the trill modulation improves the perceptibility and quality of the high modulation frequency sound components.

The use of the pre-/post-processors, in accordance with the various embodiments, will enhance the performance of radio products that use narrowband vocoders, particularly the MBE type vocoders used in P25 systems. Additionally, the pre-/post-processors of the various embodiments can be also used to improve high modulation rate encoding for any vocoder where the frame rate is insufficient to accurately encode high modulation rates. The use of the pre/post processors operating in accordance with the various embodiments will help reproduce alveolar (i.e. trilled) 'r' and other sounds thereby promoting the acceptance and sale of narrowband digital radio systems.

The IMBE/AMBE vocoder is a standard required for compatibility and interoperability in P25 (DMR) system radios. The improved intelligibility for certain speech sounds will improve the marketability of products incorporating the speech enhancement approaches provided by the various embodiments. The pre and post processing technology improves the quality and intelligibility of vocoded speech providing an improved performance and marketing advantage. Other low frame rate vocoders, such as the ACELP vocoder used in TETRA systems can also take advantage of the improved intelligibility.

The embodiments provided herein pertain to trill sound enhancement of modulation envelope filtering. The embodiments treat speech time domain amplitude nulls to affect the modulation envelope of the speech. The action of the modulation envelope filter (i.e. trill enhancement filter) is to operate on the energy envelope of the speech as opposed to spectral content of individual analysis frames in the frequency domain. The speech waveform amplitude envelope is advantageously analyzed as a group of multiple frames. The embodiments utilize the energy analysis to identify speech energy envelope nulls in the time domain for the purpose of adjusting the input frame to the vocoder by shifting it in time as opposed to systems which manipulate frequency domain parameters.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A radio, comprising:

a digital vocoder having a predetermined data frame sampling rate;

at least one processor for enhancing a modulation index of a predetermined high modulation rate sound event, the at least one processor detecting energy nulls of the predetermined high modulation rate sound event in a digitized speech stream, wherein the at least one processor comprises:

a pre-vocoder processor comprising a frame shifter for shifting a data frame of the digitized speech stream forward or backward in time relative to the vocoder frame sampling time to coincide with detected energy nulls; and wherein the frame shifter further comprises:

a voice frame energy calculator for calculating voice frame energy at a higher data frame sampling rate than the vocoder;

a differential energy calculator to determine inter-frame differences;

an energy difference classifier;

a state machine to identify and locate the nulls; and a buffer for shifting the data frame of the digitized speech stream backward or forwards based on the identified and detected energy nulls.

2. The radio of claim 1, wherein the predetermined high modulation rate sound event comprises a trill sound.

3. A radio, comprising:

a digital vocoder having a predetermined data frame sampling rate;

at least one processor for enhancing a modulation index of a predetermined high modulation rate sound event, the at least one processor detecting energy nulls of the predetermined high modulation rate sound event in a digitized speech stream, wherein the at least one processor comprises:

a pre-vocoder processor to expand in time a digitized speech input stream to the vocoder, the expansion in time reducing envelope modulation frequencies of the digitized speech input stream below that of the predetermined sampling rate of the vocoder;

and a post-vocoder processor to compress in time a digitized speech output stream from the vocoder, thereby reversing the time expansion.

4. A radio, comprising:

a digital vocoder having a predetermined data frame sampling rate; and at least one processor for enhancing a modulation index of a predetermined high modulation rate sound event, the at least one processor detecting energy nulls of the predetermined high modulation rate sound event in a digitized speech stream, wherein the at least one processor comprises:

a post-vocoder processor providing a modulation enhancement filter that filters an energy envelope of a digitized speech stream output from the vocoder to enhance the modulation index of the predetermined high modulation rate sound event, wherein the modulation enhancement filter comprises:

a time delay element to delay the digitized speech stream output from the vocoder;

an energy envelope calculation element for calculating the modulation energy envelope of the digitized speech stream from the vocoder;

a modulation domain enhancement filter providing a positive gain for predetermined modulation frequencies of the calculated energy envelope; and an energy envelope gain multiplier for imposing the filtered modulation energy envelope on the delayed digitized speech stream output from the time delay element.

5. The radio of claim 4, wherein the predetermined high modulation rate sound event comprises a trill sound.

6. A radio system, comprising:

a narrowband vocoder having a predetermined data frame analysis rate;

a plurality of pre-vocoder processors comprising:

a high modulation rate (HMR) event detector for detecting modulation amplitude nulls in a received speech signal;

a data frame shifter module for shifting vocoder analysis frames forward and backward in time to coincide with detected modulation amplitude nulls;

a processor for modifying vocoder frame energy parameters to coincide with detected modulation amplitude nulls;

a waveform time expansion processor for expanding the speech signal in time to effectively lower signal modulation frequencies;

a plurality of post-vocoder processors comprising:

a waveform time compression processor for time compressing a decoded output signal from the narrowband vocoder;

a modulation domain filter for filtering and providing a positive gain to trill modulation frequencies; and the plurality of pre-vocoder processors and post-vocoder processors enhancing modulation of an alveolar trill passing through the narrowband vocoder.

7. The radio system of claim 6, wherein the waveform time expansion processor expands the speech signal in time by 20 (twenty) percent or more.

* * * * *